US007454859B2

(12) United States Patent
Buckner

(10) Patent No.: US 7,454,859 B2
(45) Date of Patent: Nov. 25, 2008

(54) COMBINATION GUN REST AND AIMING BRACE

(76) Inventor: Gary Buckner, 333 Meadowlark, Ozark, MO (US) 65721

( * ) Notice: Subject to any disclaimer, the term of this patent is extended or adjusted under 35 U.S.C. 154(b) by 300 days.

(21) Appl. No.: 11/160,640

(22) Filed: Jul. 1, 2005

(65) Prior Publication Data

US 2007/0000163 A1 Jan. 4, 2007

(51) Int. Cl.
*F41A 27/00* (2006.01)

(52) U.S. Cl. ..... 42/94; 182/187

(58) Field of Classification Search ..... 42/95; 182/187

See application file for complete search history.

(56) References Cited

U.S. PATENT DOCUMENTS

| | | | | |
|---|---|---|---|---|
| 3,358,789 | A | 12/1967 | Laun | |
| 4,009,763 | A * | 3/1977 | Hunter | 182/187 |
| 4,331,216 | A | 5/1982 | Amacker | |
| 4,721,183 | A * | 1/1988 | Koniecka | 182/187 |
| 5,090,505 | A | 2/1992 | Amacker | |
| 5,103,935 | A | 4/1992 | Amacker | |
| 5,310,019 | A | 5/1994 | Paul | |
| 5,310,151 | A * | 5/1994 | Engel | 248/230.8 |
| 5,316,104 | A | 5/1994 | Amacker | |
| 5,368,127 | A * | 11/1994 | Phillips | 182/187 |
| 5,433,291 | A | 7/1995 | Shoestock | |
| 5,439,074 | A * | 8/1995 | Trout et al. | 182/187 |
| 5,450,927 | A * | 9/1995 | Harton et al. | 182/187 |
| 5,482,137 | A | 1/1996 | McNeill | |
| 5,491,920 | A * | 2/1996 | McCullers | 42/94 |
| 5,492,198 | A | 2/1996 | Williams | |
| 5,507,362 | A | 4/1996 | Krueger | |
| 5,723,808 | A * | 3/1998 | Devall | 89/37.04 |
| 5,845,743 | A * | 12/1998 | Dechant | 182/187 |
| RE36,276 | E * | 8/1999 | Smith | 182/187 |
| 6,243,979 | B1 * | 6/2001 | Seats et al. | 42/94 |
| 6,508,446 | B1 * | 1/2003 | Addison et al. | 248/218.4 |
| 6,510,922 | B1 * | 1/2003 | Hodnett | 182/187 |
| 6,568,505 | B1 * | 5/2003 | D'Acquisto | 182/187 |
| 6,681,892 | B2 * | 1/2004 | Husband | 182/93 |
| 6,948,690 | B1 * | 9/2005 | Sandel | 248/218.4 |
| 6,988,588 | B2 * | 1/2006 | Prejean | 182/136 |
| 7,156,206 | B2 * | 1/2007 | Prejean | 182/136 |
| 7,258,200 | B2 * | 8/2007 | Forrest | 182/187 |
| 2002/0043430 | A1 * | 4/2002 | Johnson | 182/136 |
| 2002/0088163 | A1 * | 7/2002 | Young et al. | 42/94 |
| 2002/0108811 | A1 * | 8/2002 | Ulmschneider et al. | 182/206 |
| 2002/0112919 | A1 * | 8/2002 | Graham | 182/116 |
| 2003/0024767 | A1 * | 2/2003 | Lane | 182/136 |

(Continued)

*Primary Examiner*—Troy Chambers
(74) *Attorney, Agent, or Firm*—Ishman Law Firm P.C.

(57) ABSTRACT

A combination gun rest and aiming brace being attachable to a tree or other vertical support member for use by hunters and other outdoor enthusiasts. The invention includes a generally rectangular, telescoping railing that is mechanically coupled to a tree engaging bracket. The bracket is provided with a supporting strap which encircles the tree or other support member and can be drawn tightly thereon by a ratcheting mechanism provided with the supporting strap to engage the tree. The railing is pivotally attached to the tree engaging bracket and movable from a position of use generally parallel to the ground surface to a position of non use being generally perpendicular to the ground surface. The present invention operates independently of any other apparatus and can be utilized when the user is seated on the ground adjacent to the tree or above the ground in a tree stand.

7 Claims, 8 Drawing Sheets

U.S. PATENT DOCUMENTS

2003/0192741 A1* 10/2003 Berkbuegler ..... 182/187
2004/0216351 A1* 11/2004 Eppard et al. ..... 42/94
2006/0137233 A1* 6/2006 Meeks ..... 42/94
2006/0249640 A1* 11/2006 Hanson ..... 248/214

* cited by examiner 21
17
10
35
13a
22
13b
12
15
15
11
20
14a
14b
15

COMBINATION GUN REST AND AIMING BRACE

FIELD OF INVENTION

Tree stands for engaging a tree or other generally vertical pole member for supporting a user above the ground are well known to those skilled in the art. Many such tree stands have the capability of allowing the user to face the tree, pole or other support or to face away therefrom. Some tree stands have guard rails that are designed to prevent the user from falling from the stand. A majority of tree stands, however, have no guard rail or other means to brace against and to support the hunter's rifle or the photographer's camera for long distance shots. In addition there is no convenient way to drape camouflage around the typical tree stand without rigging a cumbersome support apparatus.

Tree stands almost universally do not have any means to rest or support a gun when it is not being used. Usually a hunter will place the gun across his or her lap while waiting, sometimes for many hours, for game to come within range. Hunters have been known to fall asleep or otherwise drop their guns from the tree stand and there are a number of instances where a gun so dropped discharged either killing or injuring the hunter in the stand.

Thus, the present invention has been developed to provide a multi-purpose gun rest and aiming brace that is utilized in combination with a tree stand for outdoor activities such as hunting and wildlife photography.

DESCRIPTION OF RELATED PRIOR ART

U.S. Pat. No. 5,507,362 to Wayne C. Krueger discloses a tree stand torso bar being attachable to a tree or post to support the torso of a hunter in a tree stand and prevent the hunter from accidentally falling out of the stand. This invention comprises a sturdy oval metal frame with vertical supports which engage the trunk of a tree, a lower cross-bar connecting the vertical supports, lower inclining struts which provide additional strength, and an adjustable strap which may be tightened by a ratchet mechanism to hold the device to the tree trunk or pole.

U.S. Pat. No. 5,310,019 to Donald L. Paul discloses an improved tree stand incorporating a two part design having improved carrying capability, an adjustable shooting wrist bar designed for quiet adjustment, retractable climbing and mounting studs, improved foot straps and improved adjusting means.

U.S. Pat. No. 5,492,198 to Ralph D. Williams discloses a tree stand including a flat V-bar having an upstanding lip spaced from the tree when the V-bar engages the side of the tree opposite from the tree platform. A strap extends through the lip to secure the platform to the tree. A gun rest bracket enables a gun rest to pivot from an upright position to an inclined position, enabling the gun rest to serve as a support for the individual when in the tree.

U.S. Pat. No. 5,433,291 to Richard F. Shoestock, Sr. discloses a combination self-climbing tree stand and wheeled game carrier providing for carriage of a hunter's equipment into a relatively remote hunting site and carriage of game or other articles therefrom. A seat disposed within the tree stand configuration may be arranged toward or away from the tree and additional safety features such as storage pocket, side rails, and a foot rest may be provided.

U.S. Pat. No. 5,482,137 to Thomas L. McNeill discloses a climbing type tree stand having a seat bracket swivel mounted thereon with a seat mounted rotatively on the end of such bracket to allow a seat to be turned 360 degrees within the stand. An elevated rail system is also mounted on the stand and acts as both a guard rail and a support.

U.S. Pat. No. 4,331,216 to Joseph A. Amacker discloses a tree climbing stand for climbing an upright columnar member such as a tree, pole or the like, utilizing two climbing elements. The first climbing element has a first upright member gripping structure, a movable platform spaced from the upright member to accommodate the body of the user in a sitting position, and a gun rack. The second climbing element has a second upright member gripping structure and a platform adjacent to the upright member to accommodate the feet of the user.

U.S. Pat. No. 5,090,505 to Joseph A. Amacker discloses a tree climbing stand utilizing two climbing elements including a spring actuated element for locking the tree stand in its expanded, operational position, a retractable safety bar for supporting the back of the climber, and a cleat which may be included or excluded at the discretion of the user for engaging the tree.

U.S. Pat. No. 5,103,935 to Joseph A. Amacker discloses a tree stand with a telescoping seat for engaging a tree or other generally vertical member for supporting a user above the ground. The apparatus includes a frame for supporting the weight of the user, means for gripping a vertical member and platform means receiving the feet of the user.

U.S. Pat. No. 5,316,104 to Joseph A. Amacker discloses an automatically adjustable tree climbing stand for climbing an upright columnar member such as a tree, pole, or the like, using two climbing members. The first climbing member has a first upright member gripping structure and an adjustable platform spaced from the upright member to accommodate the body of a user in a sitting position. The second climbing member has a second upright member to accommodate the feet of the user.

Finally, U.S. Pat. No. 3,358,789 to Walter E. Laun discloses a portable tree stand for attachment to an upright columnar member such as a tree, pole, or the like, having a tree engaging member or on a platform member is pivotally attached to support the weight of the user and a ring member which encircles the torso of the user.

SUMMARY OF INVENTION

After much research and study of the above mentioned problems, the present invention has been developed to provide a combination gun rest and aiming brace apparatus that is mounted directly to a tree, independent of any other means such as a tree stand. The present invention can be used by a person standing on the ground, sitting on a folding stool or off the ground in a tree stand. The present invention is portable, extremely light weight and yet very sturdy when in use.

In addition, the present device is adjustable in size to accommodate varying shooting positions and is padded to reduce noise which would alert game to the user's presence.

The user of the present invention can position his rifle, shot gun or bow across the present invention such that it functions as a gun or bow rest while waiting for game to approach. Thus, the transition from a rest position to a shooting position can be accomplished quickly and silently.

When the combination gun rest and shooting brace of the present invention is not being utilized, it can be pivoted out of the way from a generally horizontal position to a generally vertical position. The present invention can also be locked in the generally vertical position when not in use and remain mounted on its support for extended periods of time. In such case it can be considered semi-permanent as many tree stands are during hunting season.

The present device is extremely easy to mount and can just as easily be removed when no longer needed.

DETAILED DESCRIPTION OF THE INVENTION

Figure 1:
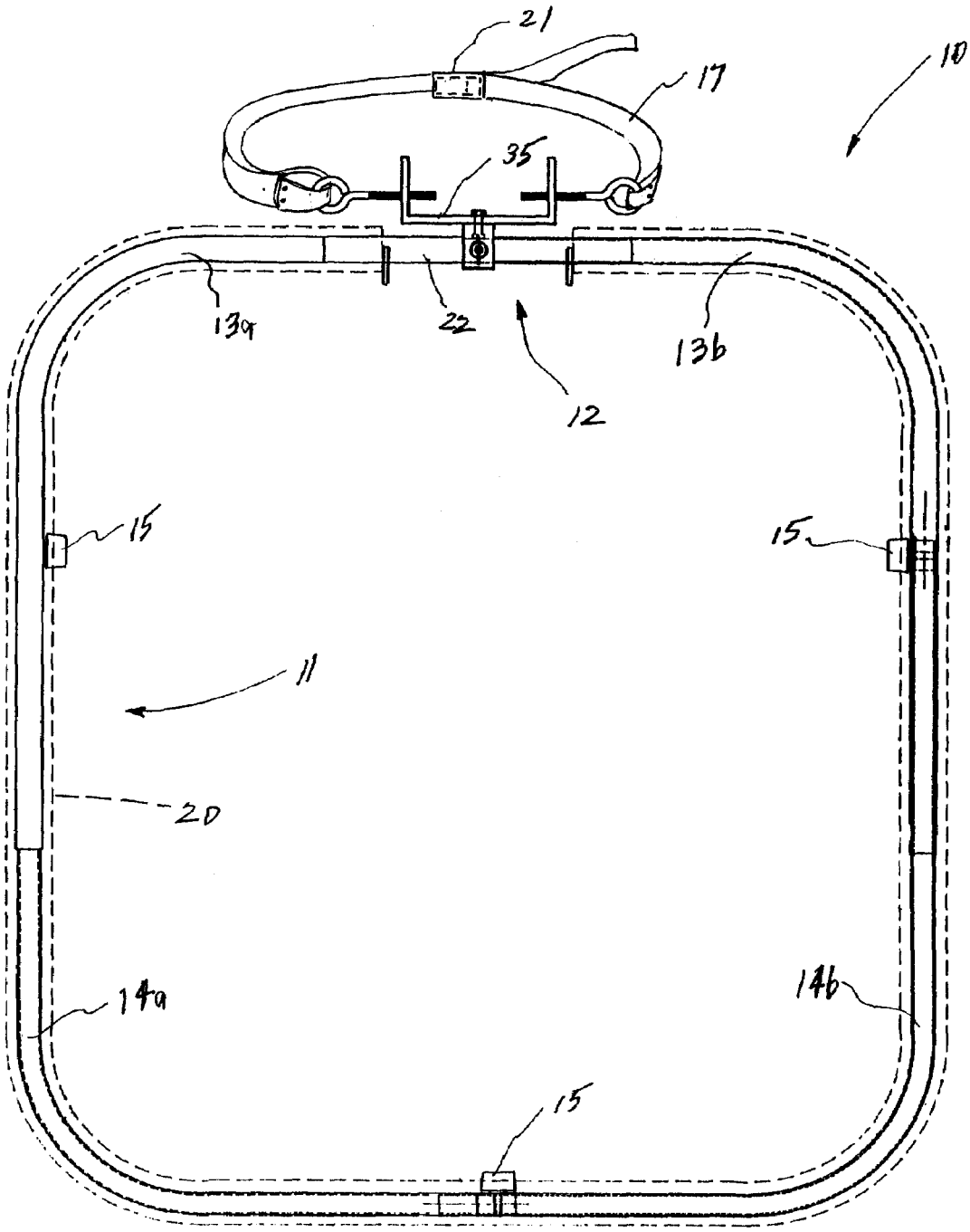
FIG. 1 is a plan view of the combination gun rest and aiming brace of the present invention.

With further reference to the drawings, there is shown therein a combination gun rest and aiming brace in accordance with the present invention, indicated generally at 10 and illustrated in FIG. 1. The combination gun rest and aiming brace 10 includes a generally rectangular railing portion, indicated generally at 11 and a tree engaging portion, indicated generally at 12.

Figure 2:
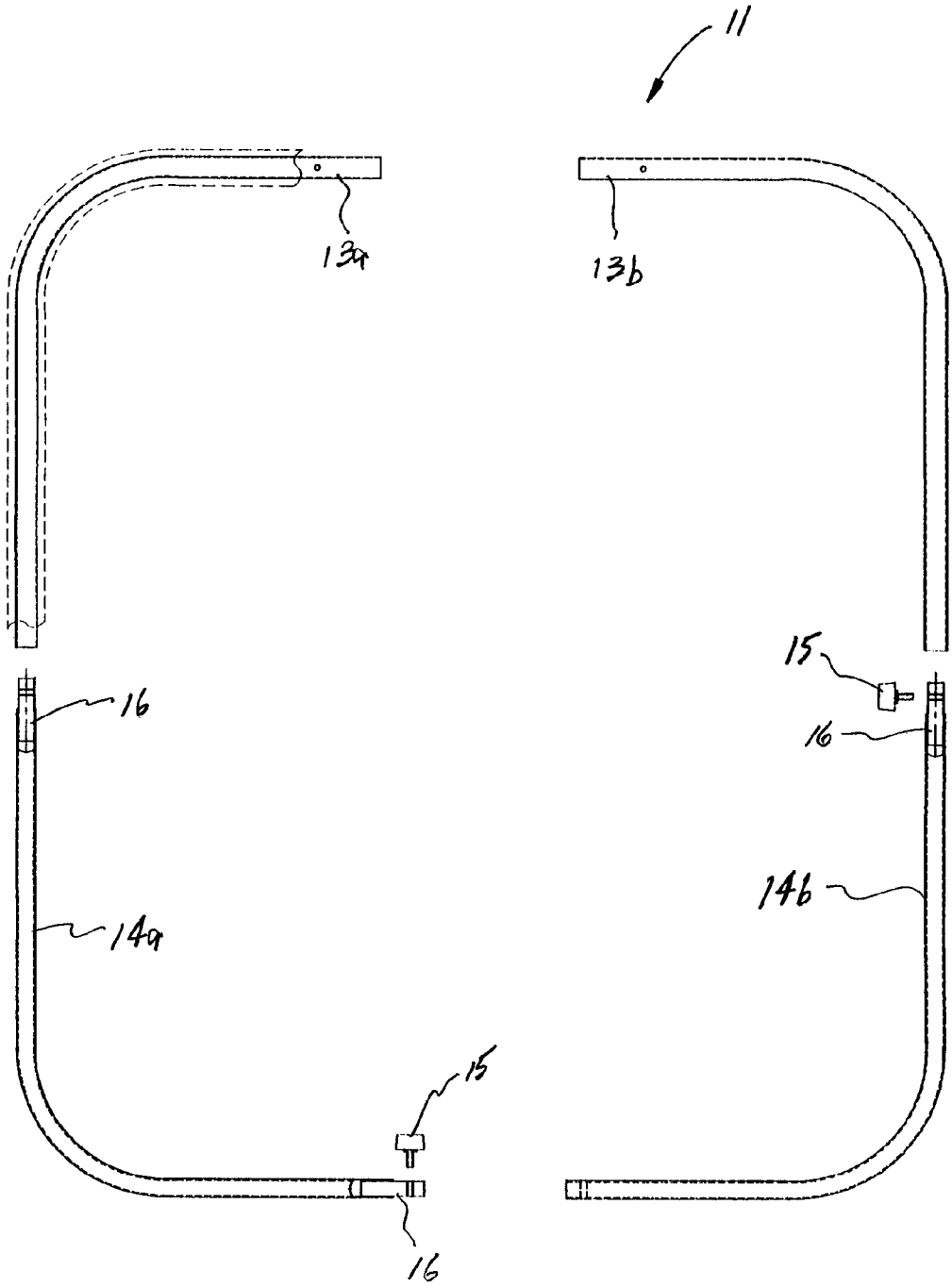
FIG. 2 is an exploded plan view of the railing portion of the present invention showing the components thereof.

In the preferred embodiment the railing portion 11 is comprised of a pair of L-shaped tubular members 13*a* and 13*b* which telescopically engage a second pair of tubular members 14*a* and 14*b*. The mating ends of tubular sections 13*a* and 14*a* and also 13*b* and 14*b* are mechanically coupled by the use of thumbscrews 15 which threadably engage a cylindrical plug 16 that is installed to an interference fit within the telescoping ends of the sections 14*a* and 14*b* as shown in FIG. 2.

Similarly, a thumbscrew 15 threadably engages a plug 16 which interconnects the adjacent ends of tubular sections 14*a* and 14*b* to form a fixed connection therebetween.

Figure 3:
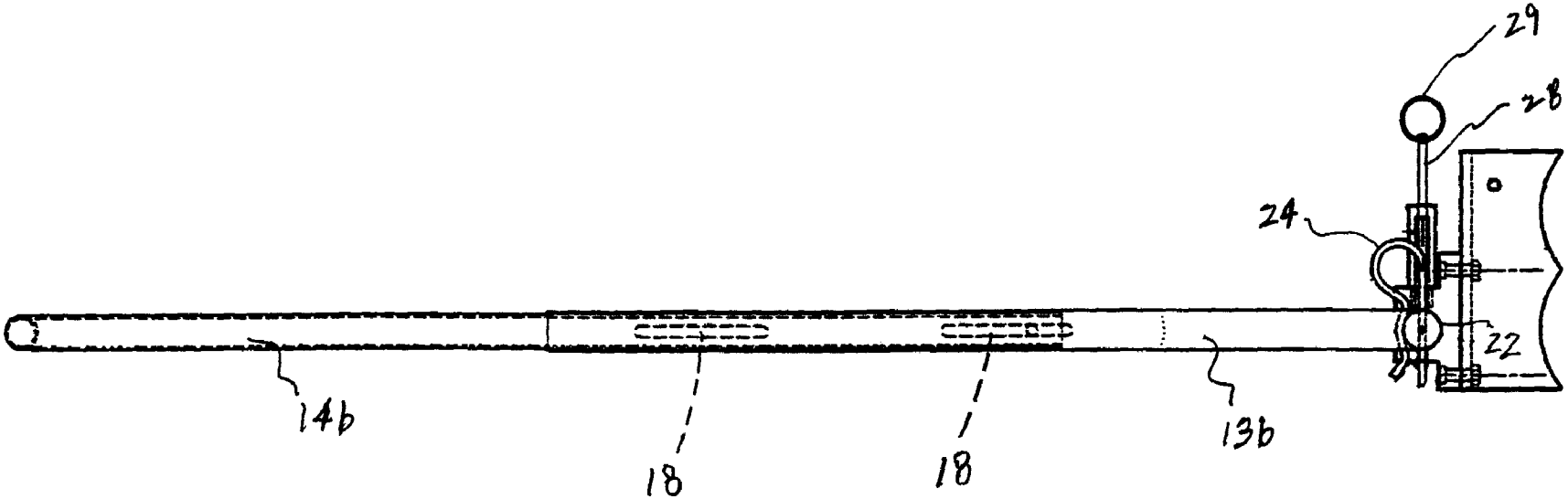
FIG. 3 is a side elevational view of the present invention showing details thereof.

As shown in FIG. 3 the distal ends of the sections 13*a* and 13*b* are provided with an elongated slot 18 on the inwardly facing surfaces thereof to provide an adjustable connection between the telescoping sections 13*a* and 14*a* and 13*b* and 14*b*. Thus, the perimeter of the railing 11 may be telescopically adjusted to fit a particular installation of the present invention by loosening the thumbscrews 15 and sliding the sections 14*a* and 14*b* inwardly or outwardly to the desired position and thereafter tightening the thumbscrews 15.

In the preferred embodiment the railing portion 11 is covered by a relatively soft, closed cell foam rubber sleeve 20 which is installed over the tubular sections of the railing 11 prior to their telescopic attachment to permit adjustment thereof. The foam sleeves 20 prevent metal-to-metal contact between a gun 31 and the gun rest 10 which would otherwise create noise to alert game animals to the presence of the user as well as to cause damage to the finish of the weapon.

Figure 4:
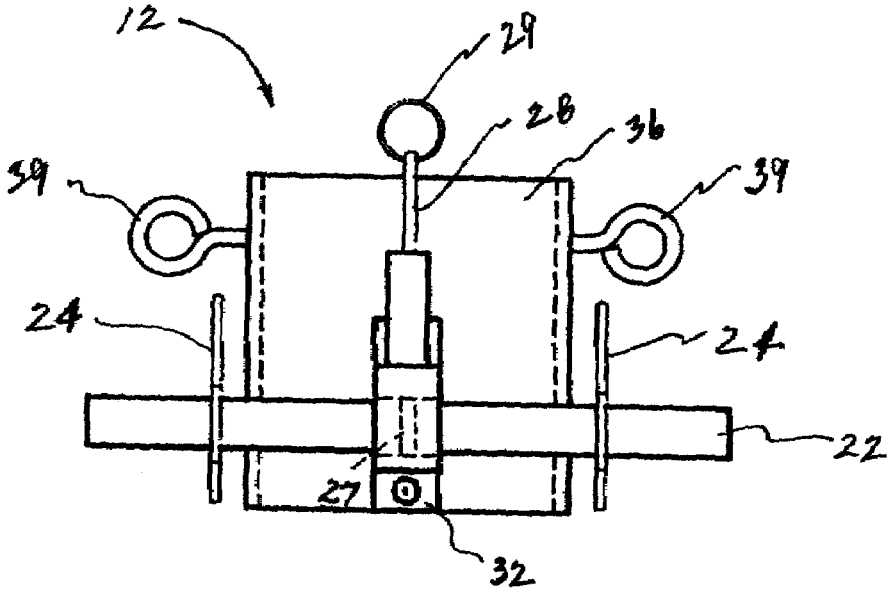
FIG. 4 is an enlarged elevational view of the tree engaging portion of the present invention.
Figure 5:
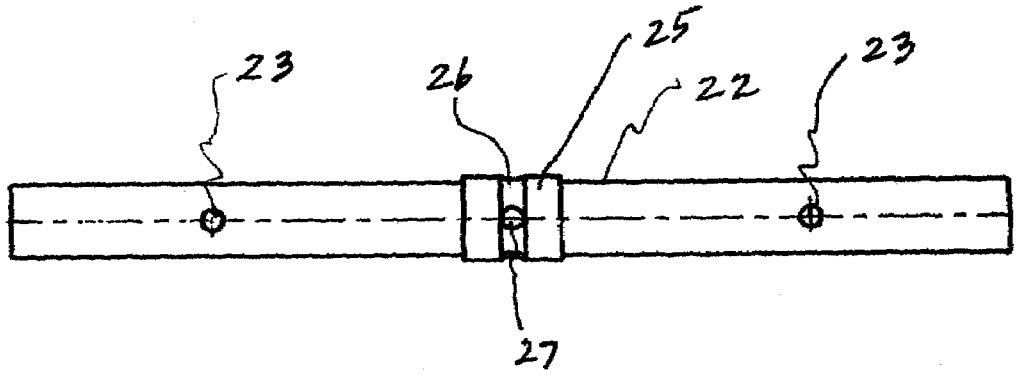
FIG. 5 is an enlarged elevational view of the axle component of the present invention.

The proximal ends of the tubular sections 13*a* and 13*b* slidingly engage an axle member 22 as seen in FIG. 1 which is a component of the tree engaging portion 12 as more clearly shown in FIG. 4. Axle 22 is comprised of a cylindrical shaft of a suitable material such as aluminum or a composite material that is dimensioned to be inserted into the proximal ends of the tubular sections 13*a* and 13*b*. Axle 22 is cross-drilled as shown in FIG. 5 to provide holes 23 for the insertion of clevis pins 24 therethrough to secure the tubular sections 13*a* and 13*b* thereon during assembly.

In the preferred embodiment the axle 22 includes a central shoulder portion 25 having a slightly larger diameter than the rest of the axle whereon a semicircular groove 26 is formed. A locating hole 27 is drilled through the axle 22 at the groove 26 and is adapted to receive a spring-loaded, locating pin 28 having a finger loop 29 attached thereto as shown in FIG. 4.

Figure 6:
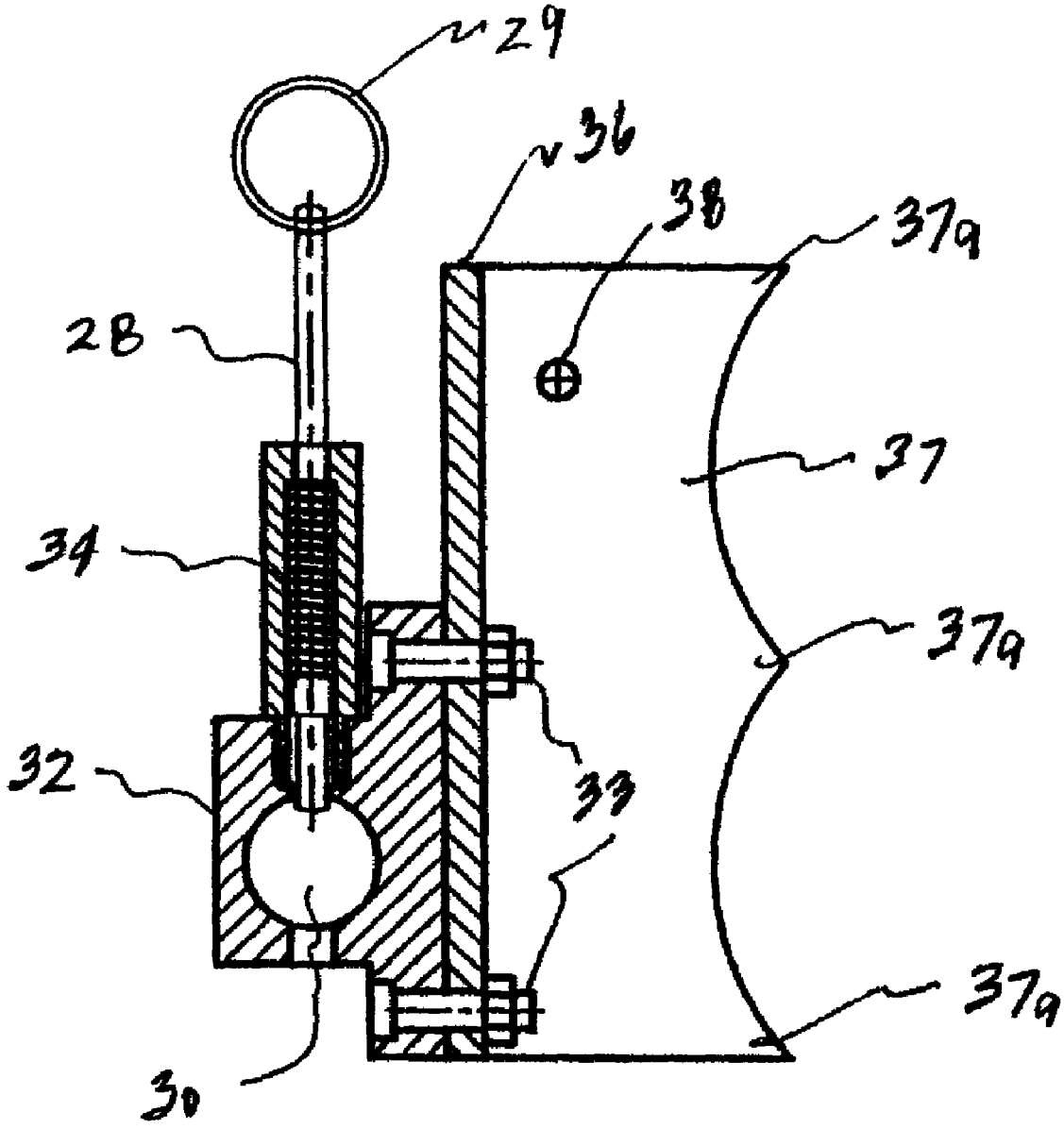
FIG. 6 is a cross-sectional view of the spring-loaded locating pin installed in the axle block of the present invention.

Axle 22 is disposed within an opening 30 formed in the axle block 32 as clearly shown in FIG. 6. Thus, to install the axle 22 in its functional position within the axle block 32, the axle 22 is advanced into the opening 30 until the shoulder portion 25 contacts the pin 28. Thereafter, the pin 28 is drawn upwardly against the tension of spring 34 and the axle 22 is advanced until the groove 26 and the locating pin 28 are in alignment. Then, the pin 28 is released, projecting into the locating hole 27 to secure the axle 22 in position.

The axle block 32 is fixedly attached to the tree engaging bracket 35 utilizing machine bolts 33 as shown in FIG. 6. In the preferred embodiment bracket 35 is a U-shaped channel construction when viewed in cross-section including a back plate 36 and a pair of perpendicular flanges 37 projecting outwardly therefrom.

The flanges 37 include a plurality of teeth 37*a* formed at the distal edges thereof for engaging a tree 40 or other vertical support member. In the preferred embodiment teeth 37*a* are formed by machining a plurality of radii into the distal edges of flanges 37 to form the outwardly projecting teeth 37*a* seen in FIG. 6.

Of course, various tooth configurations for engaging a tree or other vertical support member can be devised and are considered to be within the scope of the present invention. Thus, the particular embodiment illustrated herein is intended to be merely illustrative and not restrictive in any sense.

Figure 7:
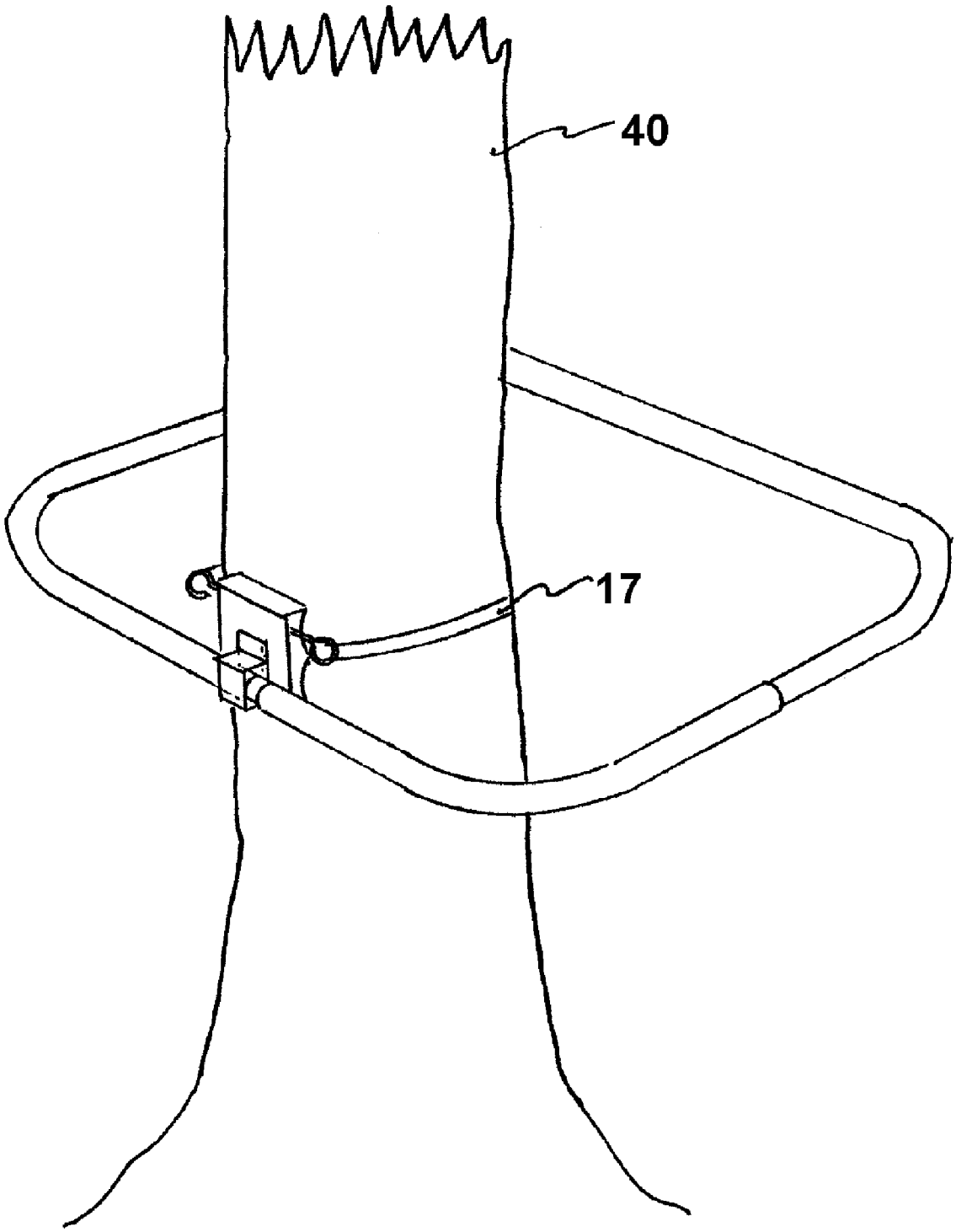
FIG. 7 is a perspective view of the present invention shown installed at the base of a tree.

Each flange 37 is drilled and tapped to provide coaxial threaded holes 38 which receive mating eyebolts 39 being installed therein as shown in FIG. 4. The eyebolts 39 are utilized to attach a support strap 17 which encircles a tree 40 or other vertical support member whereon the gun rest/aiming brace 10 is to be installed as shown in FIG. 7. A ratchet mechanism 21 permits strap 17 and, thus, the attached tree bracket 35 with projecting teeth 37*a* to be drawn tightly around a tree 40 or other vertical support member around which the present invention is to be installed.

Since such straps and ratchet mechanisms are well known to those skilled in the art, further discussion of the same is not deemed necessary.

Figure 8:
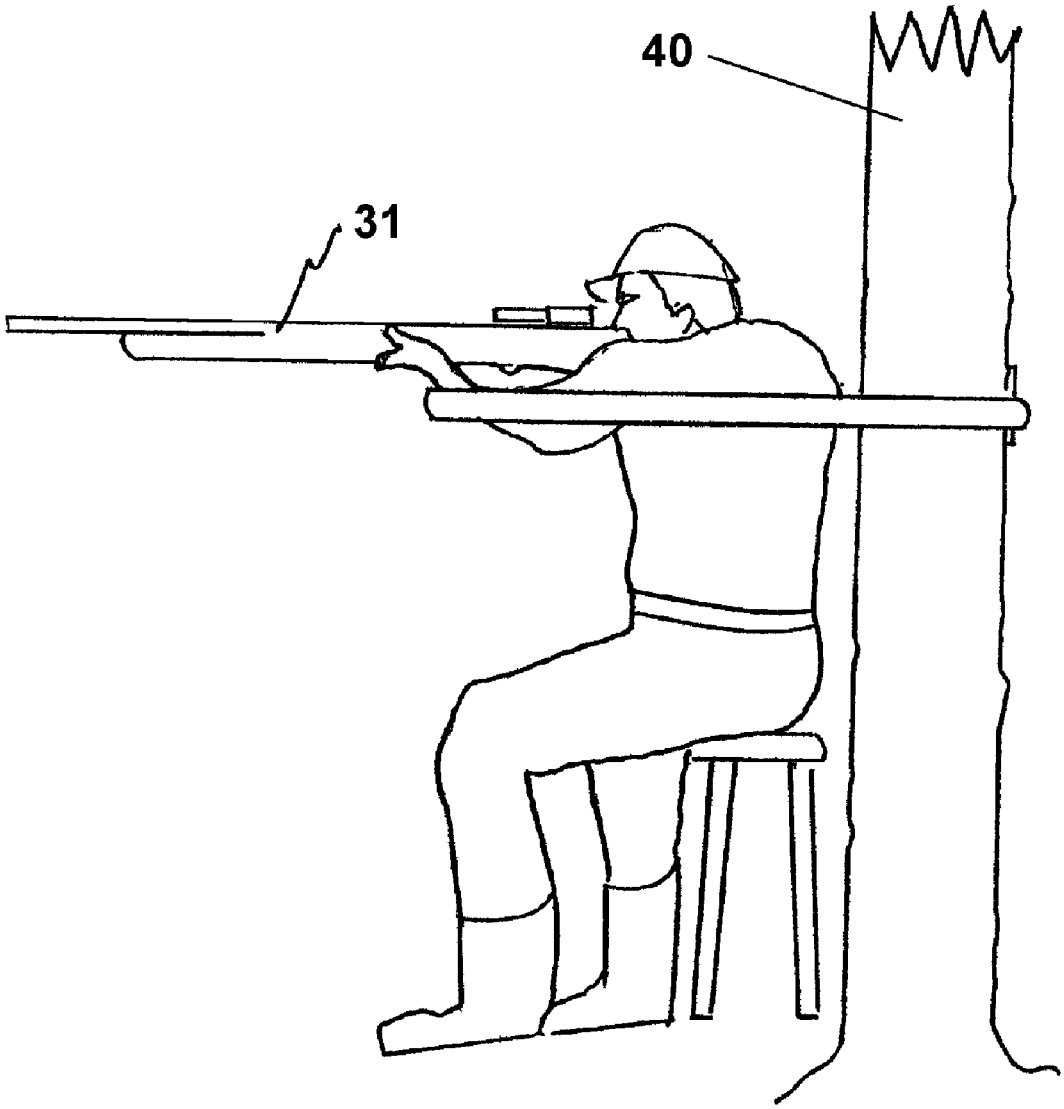
FIG. 8 is a perspective view of the present invention being utilized by a hunter as an aiming brace.
Figure 9:
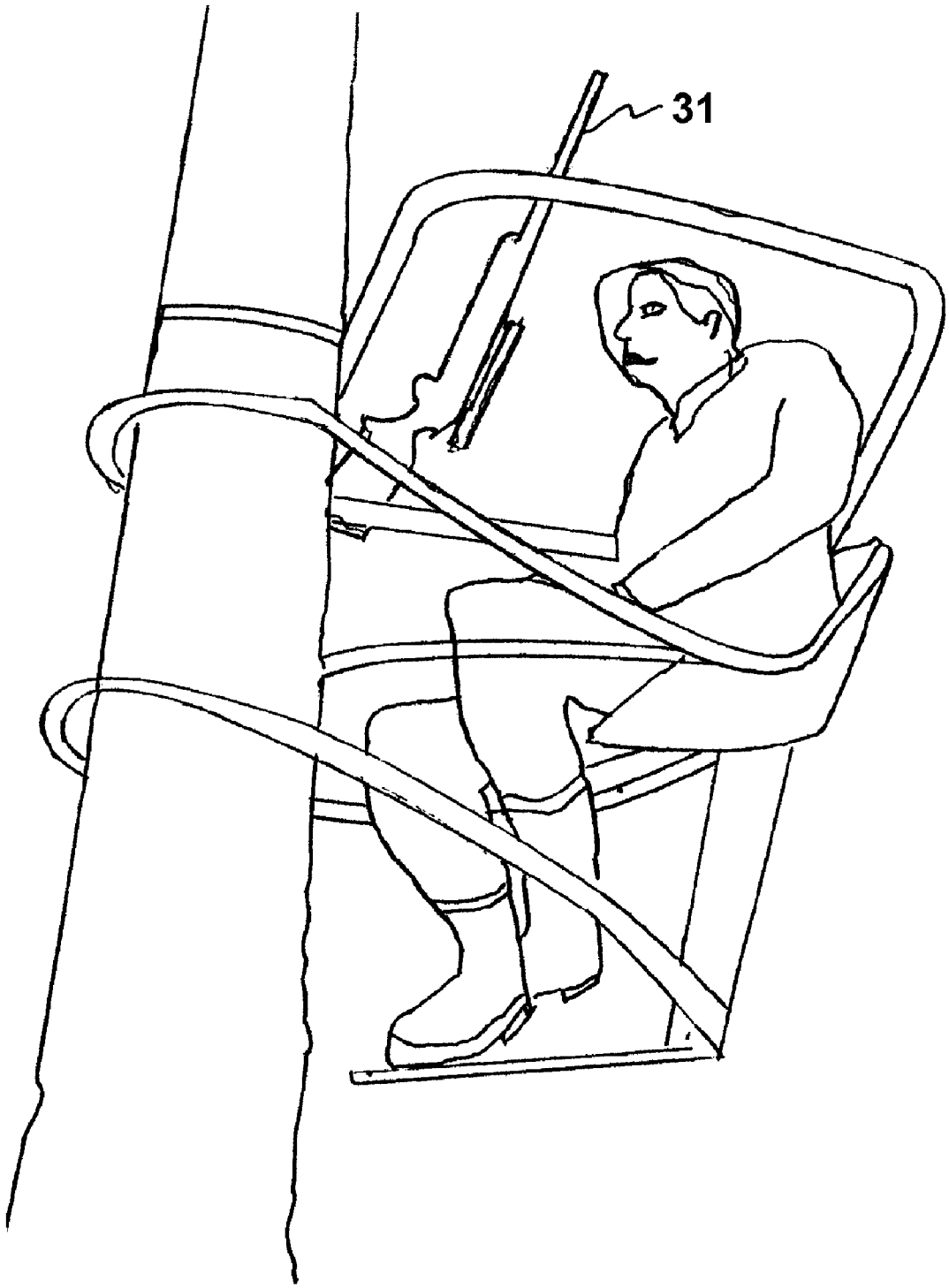
FIG. 9 is a perspective view of the present invention being utilized as a gun rest by a hunter seated in a tree stand.

The combination gun rest and aiming brace 10 of the present invention can be utilized alternately as a gun rest as shown in FIG. 9 or as an aiming brace as shown in FIG. 8. If the user is facing toward the tree or other support as shown in FIG. 9, the present invention is mounted on the user's side of the tree. In the alternative if the user is facing away from the tree as shown in FIG. 8 the present invention is mounted on the opposite side of the tree with the telescoping rail 11 being adjusted to the user.

From the above it can be seen that the present invention provides a combination gun rest and aiming brace that operates independently of any other apparatus such as a tree stand and yet can be utilized in conjunction with a user seated on the ground adjacent to a tree as well as in an elevated position on a tree stand.

In addition, the present invention can be adjusted by telescopically extending the railings depending upon the direction in which the user is facing and the user's preference.

Further, the present invention also provides a framework for supporting camouflage material (not shown) to construct a so-called blind wherein a hunter may conceal himself while waiting for game to approach.

The terms "inner", "outer", "side", and so forth have been used herein merely for convenience to describe the present invention and its parts as oriented in the drawings. It is to be understood, however, that these terms are in no way limiting to the invention since such invention may obviously be disposed in different orientations when in use.

The present invention may, of course, be carried out in other specific ways than those herein set forth without departing from the spirit and essential characteristics of such invention. The present embodiments are, therefore, to be considered in all respects as illustrative and not restrictive, and all changes coming within the meaning and equivalency range of the appended claims are intended to be embraced therein.

What is claimed is:

1. A combination gun rest and aiming brace for a hunter positioned adjacent a tree, said brace comprising:

a bracket assembly having a base and a pair of laterally spaced rearwardly and vertically extending flanges for engaging the tree, said bracket assembly having a lateral cylindrical opening between said flanges;

a supporting strap attached to said bracket assembly for encircling the tree and adjustable for securing said bracket assembly thereto;

a cylindrical axle having a center portion rotatably supported in said opening in said bracket assembly and having lateral ends extending outwardly therefrom, said center portion having a cross hole formed therein;

a generally rectangular railing assembly formed of a tubular material, said railing member having a rear section and a front section, said rear section including a pair of L-shaped members having lateral rear legs with inner proximal ends connected with said lateral ends of said axle at rear releasable couplings and side legs laterally spaced and extending outwardly from said bracket assembly and terminating with distal ends, said front section connected with said distal ends at side releasable couplings thereby forming a rectangular perimeter for encircling the hunter in a horizontal use position; and a locking member on said bracket assembly for releasably maintaining said railing assembly in said use position, said locking member including a sliding pin being inserted into said cross hole in said center portion of said axle when said railing assembly is in said use position to maintain a locked position, said pin being removed from said cross hole to permit rotation of said axle and movement of the railing member to a non-use position.

2. The combination gun rest and aiming brace as recited in claim 1 wherein said front section of said railing assembly includes a second pair of L-shaped members having side legs connected at said side releasable couplings with said side legs of said rear section and front legs are connected at a front releasable coupling.

3. The combination gun rest and aiming brace as recited in claim 2 wherein said side releasable couplings are telescopic.

4. The combination gun rest and aiming brace as recited in claim 3 wherein said side and front releasable couplings include fasteners for maintaining fixed positions therefor.

5. The combination gun rest and aiming brace as recited in claim 4 wherein said rear releasable couplings are clevis pins extending through cross holes in said rear legs and said lateral ends of said axle.

6. The combination gun rest and aiming brace as recited in claim 5 wherein said pin is spring biased to said locked position, and said center section of said axle includes a circumferential groove for said pin in movement to said non-use position.

7. The combination gun rest and aiming brace as recited in claim 6 wherein each of said sections of said railing assembly includes a foam rubber sleeve.

* * * * *